US006068483A

United States Patent [19]

Minor

[11] Patent Number: 6,068,483

[45] Date of Patent: May 30, 2000

[54] SIMULATED FIREARM SIGHT ALIGNMENT TRAINING SYSTEM

[76] Inventor: Fidel Nikita Minor, P.O. Box 4800, Poughkeepsie, N.Y. 12601

[21] Appl. No.: 09/272,995

[22] Filed: Mar. 20, 1999

[51] Int. Cl.[7] ..... F41G 3/26

[52] U.S. Cl. ..... 434/19; 434/19; 42/100

[58] Field of Search ..... 356/138, 153; 434/19, 21; 42/100

[56] References Cited

U.S. PATENT DOCUMENTS 3,838,522 10/1974 Williams .
4,945,667 8/1990 Rogalski et al. .

*Primary Examiner*—Sam Rimell
*Attorney, Agent, or Firm*—Morgan & Finnegan, L.L.P.

[57] ABSTRACT

A simulated firearm sight alignment system designed to teach a person, without the actual use of a firearm, to accurately manually align the sights of any firearm having front and rear open firearm sights or front and rear peep firearm sights. The system uses a simulated firearm sight tool that operates in two modes: simulated peep firearm sight mode and simulated open firearm sight mode. The simulated peep firearm sight mode is acquired when the simulated firearm sight tool has the simulated front peep firearm sight attachment tenon attached to its barrel's front "T" shaped mortise and the simulated rear peep firearm attachment tenon attached to its rear "T" shaped mortise simultaneously. The simulated open firearm sight mode is acquired when the simulated front open firearm sight attachment tenon is attached to the barrel's front "T" shaped mortis and the simulated rear open firearm sight attachment tenon is attached to the barrel's rear "T" shaped mortise simultaneously. The simulated firearm sight tool is held in the hand by grasping the stock attachment, which is attached to the barrel by sliding the longitudinal "T" shaped post into the semi-longitudinal "T" shaped dock located on the bottom side of the barrel. Then, after inserting the mini-target into the mini-target holder and positioning the mini-target holder with inserted mini-target approximately five to ten feet and at eye level directly in front of the simulated firearm sight tool user, the simulated firearm sight tool is lifted to the open left or right eye wherein the simulated front and rear firearm sights are positioned to create simulated firearm sight alignment. While maintaining simulated firearm sight alignment, the clearly focused simulated front sight post is aimed at and positioned onto the proper point of impact on the mini-target, creating a simulated firearm sight picture.

18 Claims, 11 Drawing Sheets

FIGURE 1
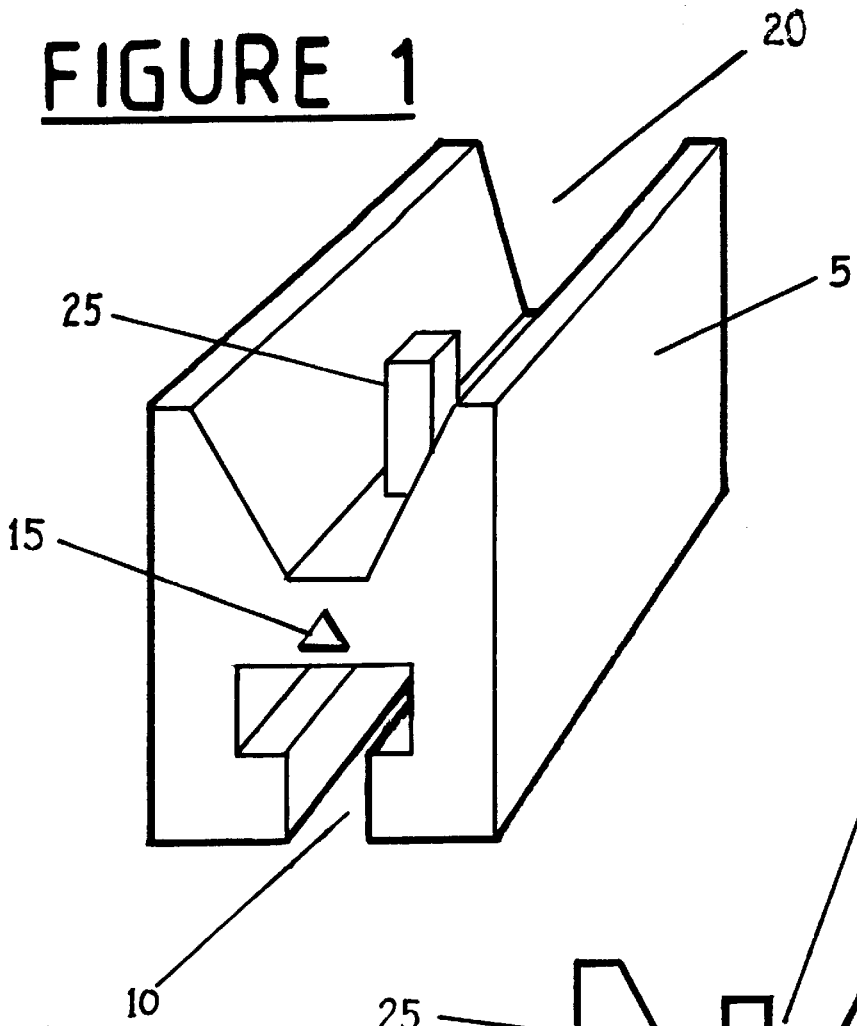
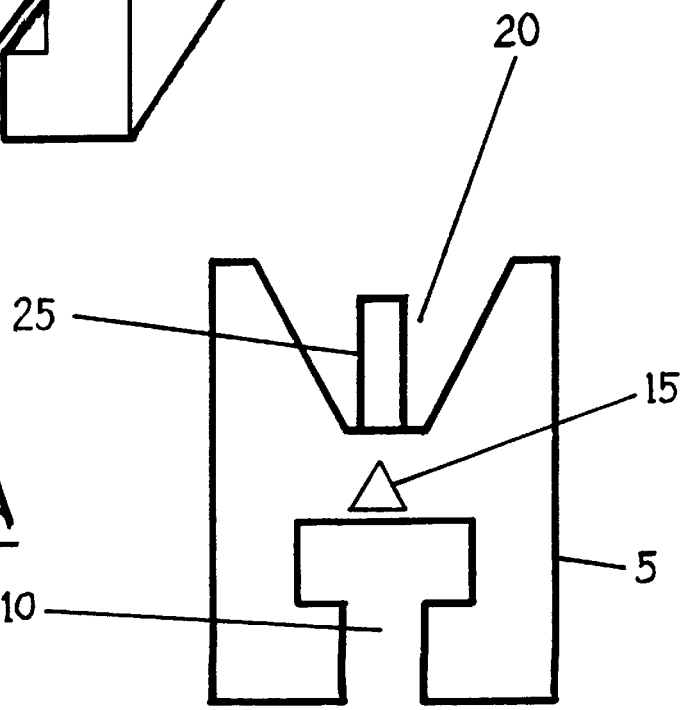
FIGURE 1A

FIGURE 2
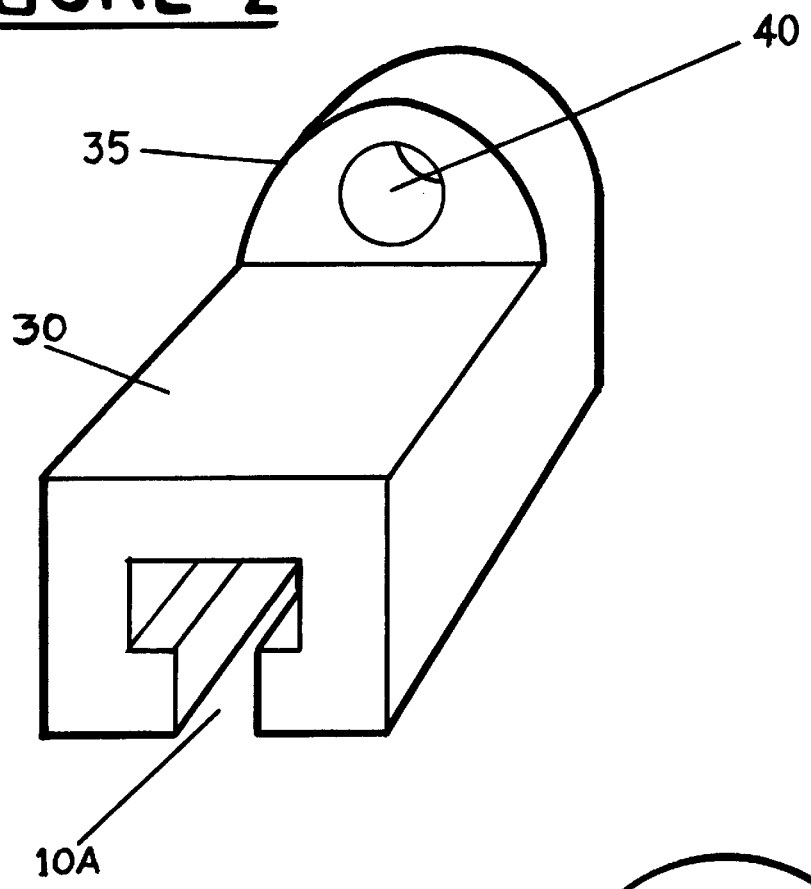
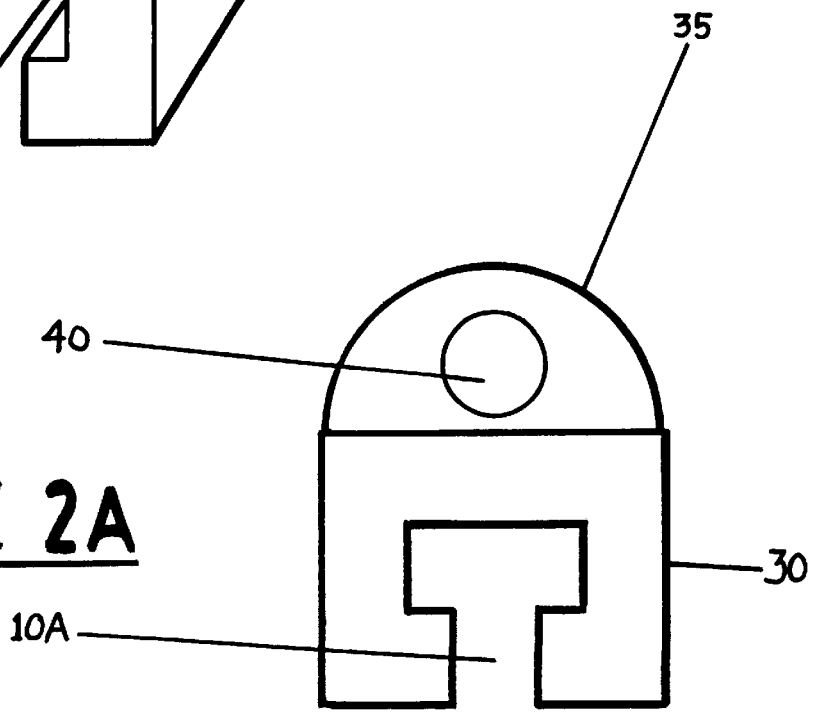
FIGURE 2A

FIGURE 3
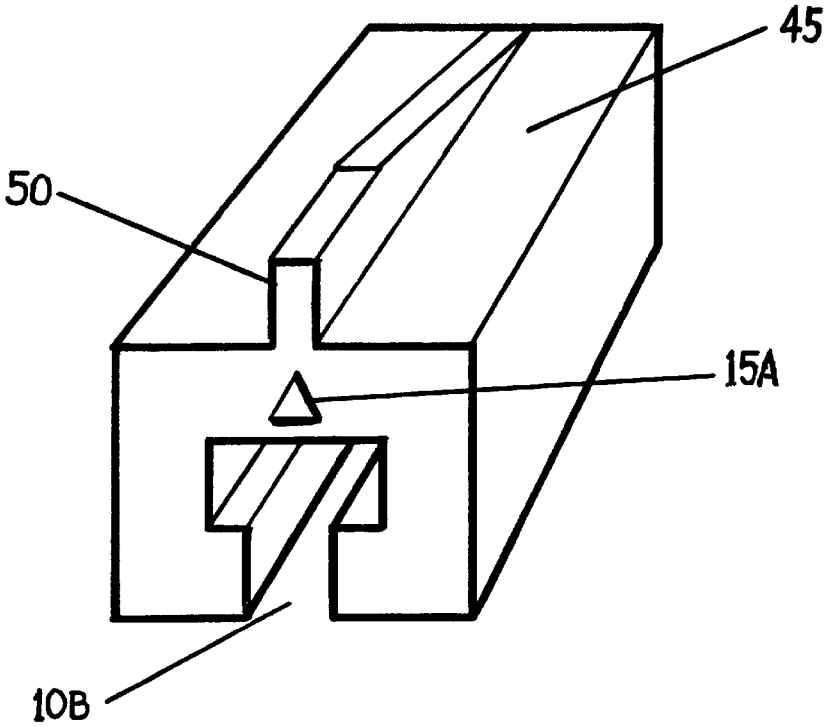
FIGURE 3A
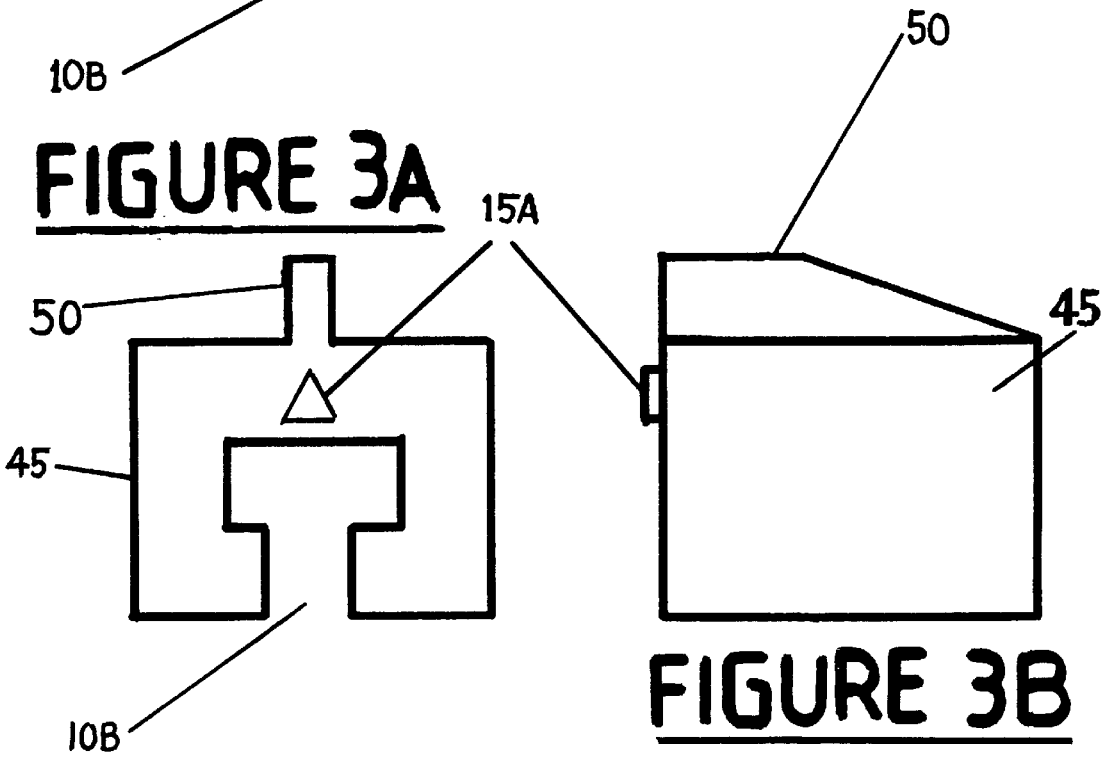
FIGURE 3B

FIGURE 4
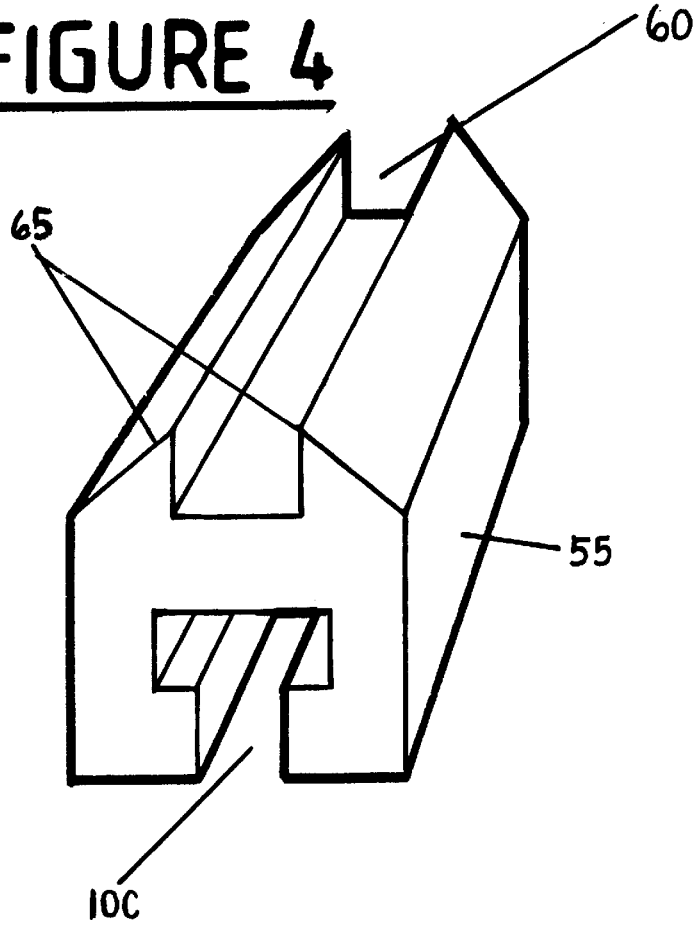
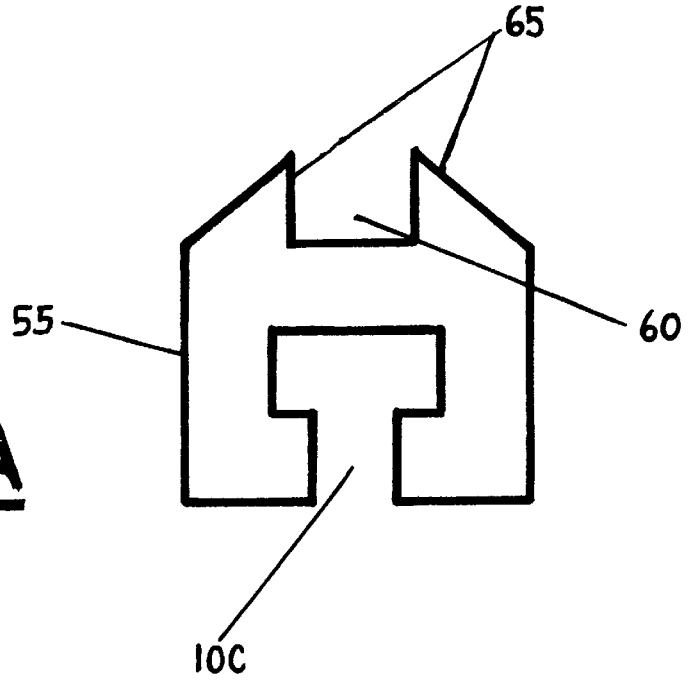
FIGURE 4A

SIMULATED FIREARM SIGHT ALIGNMENT TRAINING SYSTEM

FIELD OF THE INVENTION

This invention relates to a simulated firearm sight alignment system that, without the actual use of a firearm, will teach a person to accurately align the sights of any firearm having peep firearm sights and/or open firearm sights to correspond to the point of impact of projectiles expelled from said firearm.

BACKGROUND OF THE INVENTION

When firearms instructors in training academies and boot camps train new recruits to use firearnis, five basic fundamentals are taught: (1) proper feet positioning (or stance), (2) proper breathing, (3) grip or (the proper holding of the stock), (4) trigger control, and (5) firearms sight alignment. In many cases, these fundamentals are taught in a classroom setting, where one firearms instructor lectures to thirty or more recruits using textbook diagrams and one real example of the firearm or firearms to be fired.

Generally, stance, proper breathing, grip and trigger control are easily mastered by most recruits using this classroom method. However, firearms sight alignment is not so easily mastered. In many cases, lecturing, diagrams and written descriptions of how properly aligned firearms sights should look to the person aiming the firearm did not prove to be effective or adequate teaching strategies and led to poor shooting performance by many recruits.

Inventors have created several types of devices and systems that aid in the aligning of firearms sights. U.S. Pat. No. 5,446,535 (Williams) discloses a complex firearms sight alignment system which allows for the use of a collimated beam light source attached to a housing which binds the light beam with the direction of the firearm barrel. This light source thus provides a point at which to adjust the sighting apparatus of the firearm while the light source is shining upon an object some distance in front of the firearm barrel. This system is impractical for safe use in a classroom because it must be attached to an aimed firearm in order to perform its function. Also, the entire system will not work unless the laser beam is fully functional. In order for the laser beam to remain fully functional, a fallible rechargeable power source must be used. Also, the user is burdened with the repetitious, costly, time-consuming act of recharging the power source. This system is prohibitively costly to maintain, complicated to use, and expensive to manufacture.

U.S. Pat. No. 5,519,941 (Yusko), discloses a sight provided for a weapon or other device requiring manual alignment with a target along a viewing line, the weapon having a barrel with front and rear sights. The sights are structured to provide sufficient visual cues to the shooter to enable effective aiming while focusing on the target rather than the sight. This system is also not practical for safe use in a classroom, because it too requires an aimed firearm in order to perform its function. Also this system is, in principle and operation, a contrast to traditional firearms target shooting instruction, where it is taught to concentrate on the front sight, and not the target, while aiming the firearm.

Inventors have created numerous systems and devices that are designed to improve the ability to more accurately align firearm sights, but all of the systems and devices heretofore known suffer from a number of disadvantages:

(a) they are complex in their design; requiring high tech lasers, scopes, costly rechargeable power supplies, and aimed firearms in order to perform their function.

(b) They are not designed to teach a person who has no knowledge of firearm sight alignment how to manually align the sights of a firearm, but are designed to improve upon a person's existing firearm sight alignment knowledge.

(c) They require the user to physically aim a firearm, which may be an intimidating factor to a person who has no experience with and/or knowledge about firearms, and may inhibit the learning person from retaining an important verbal instruction and/or information relating to firearm sight alignment.

There are several objects and advantages of the present invention, and they are as follows:

(a) This system, with complete and proper use, is effective and will teach a user to understand and manually achieve accurate firearm sight alignment of both peep firearm sights and open firearm sights;

(b) this system does not require the use of a firearm;

(c) is designed for safe, private use at home, in a barracks or squad bay type setting, or in a classroom;

(d) is easy to understand and may be used by all age groups;

(e) is a useful tool in the training of military and law enforcement recruits and personnel in the use of firearms;

(f) is easy to assemble and disassemble;

(g) gives requalifying shooters a useful tool to aid in refamiliarizing themselves with the technique of achieving accurate firearm sight alignment; and (h) is enjoyable to use.

Furthermore, this invention is designed to give new shooters the confidence of truly knowing what it takes to accurately align the sights of a firearm by providing a system that allows a person to safely educate themselves and/or others on the subject of firearm sight alignment, without the actual use of a firearm.

SUMMARY OF THE INVENTION

In accordance with the present invention, a simulated firearm sight alignment training system comprises a simulated front peep firearm sight attachment tenon, a simulated rear peep firearm sight attachment tenon, a simulated front open firearm sight attachment tenon, a simulated rear open firearm sight attachment tenon, a stock attachment, a barrel, a mini-target holder, and a mini target.

BRIEF DESCRIPTION OF THE DRAWINGS

FIG. 1 shows the three quarters view of the simulated front peep firearm sight attachment tenon.

FIG. 1A shows the front view of the simulated front peep firearm sight attachment tenon of FIG. 1.

FIG. 2 shows the three quarters view of the simulated rear peep firearm sight attachment tenon.

FIG. 2A shows the front view of the simulated rear peep firearm sight attachment tenon of FIG. 2.

FIG. 3 shows the three quarters view of the simulated front open firearm sight attachment tenon.

FIG. 3A shows the front view of the simulated front open firearm sight attachment tenon of FIG. 3.

FIG. 3B shows the side view of the simulated front open firearm sight attachment tenon of FIG. 3.

FIG. 4 shows the three quarters view of the simulated rear open firearm sight attachment tenon.

FIG. 4A shows the front view of the simulated rear open firearm sight attachment tenon of FIG. 4.

DETAILED DESCRIPTION OF THE INVENTION

Figure 5:
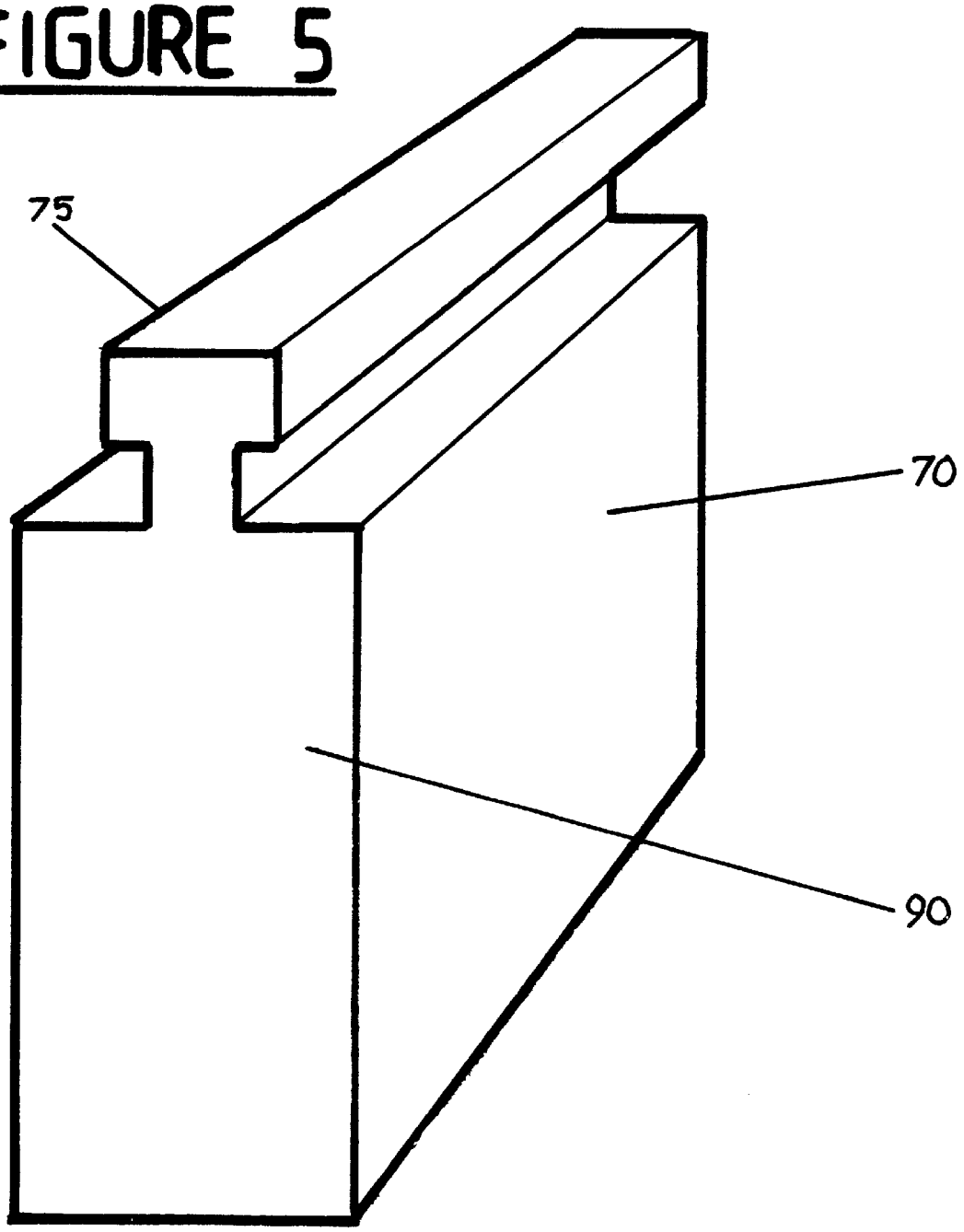
FIG. 5 shows the three quarters view of the stock attachment piece.
Figures 6, 6A:
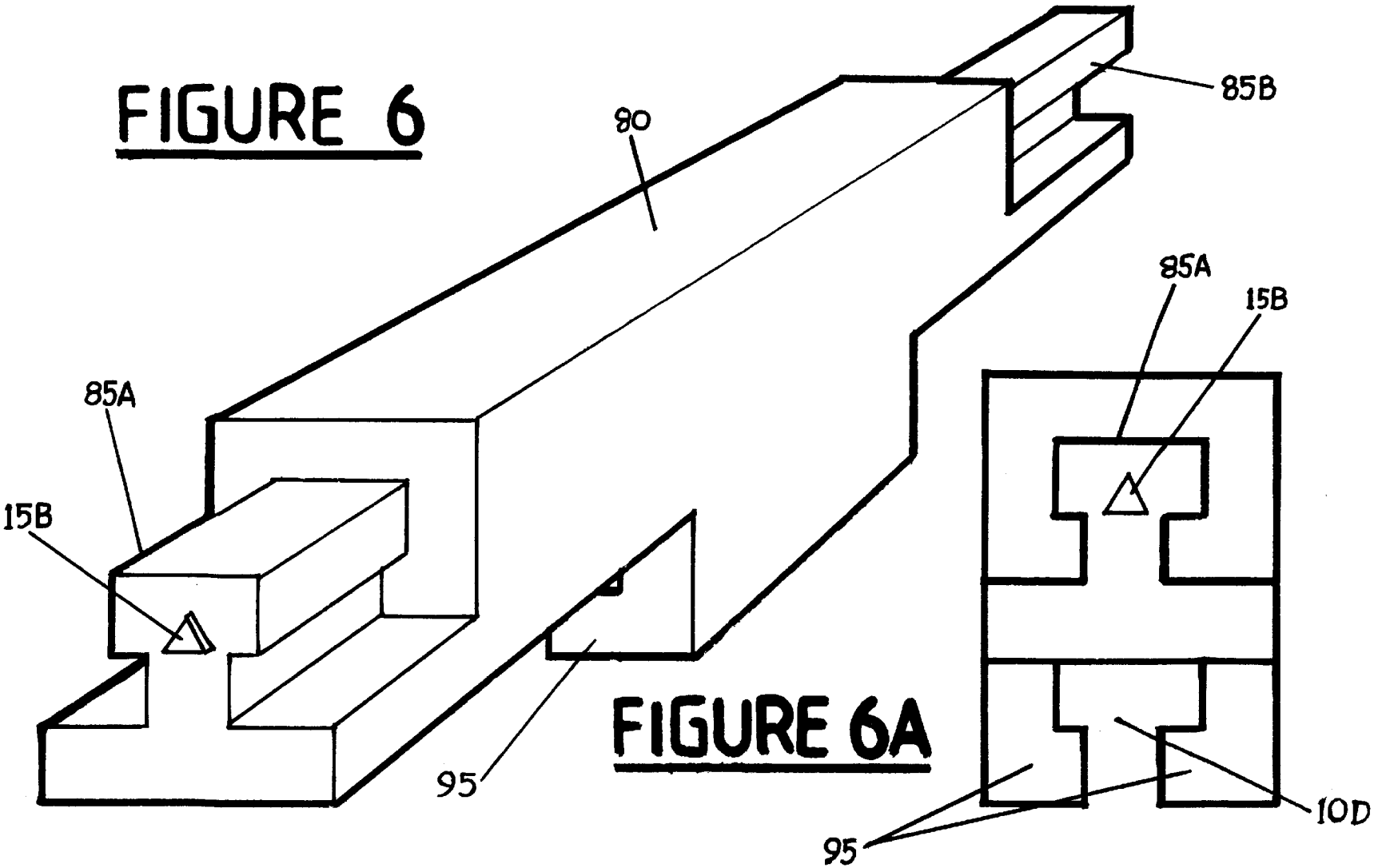
FIG. 6 shows the three quarters view of the barrel, which is a rectangular shaped structure with a "T" shaped mortise of equal size and shape on both the front top and rear top sides.
FIG. 6A shows the front view of the barrel of FIG. 6.
Figure 7:
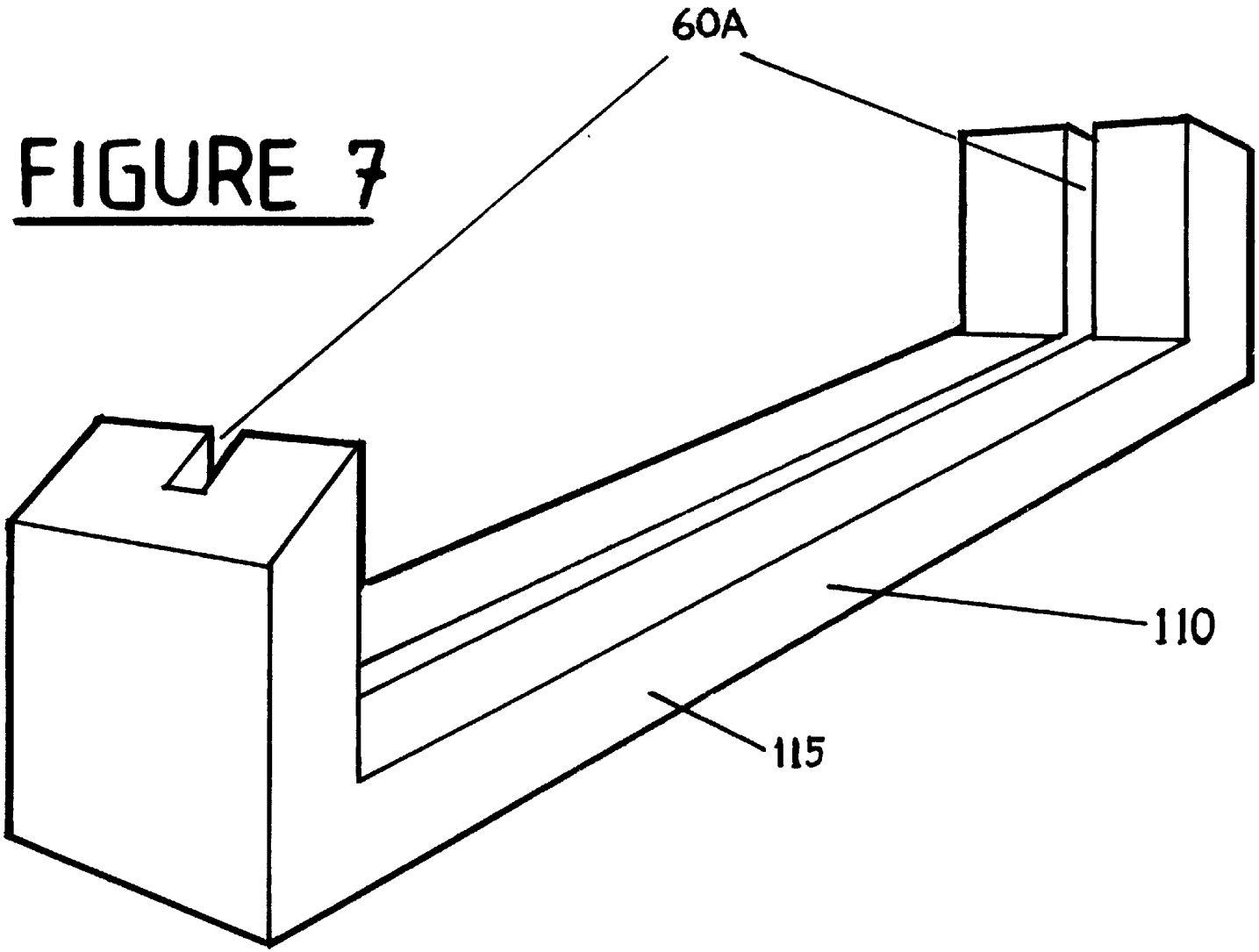
FIG. 7 shows a three quarters view of the mini-target holder.
Figure 8:
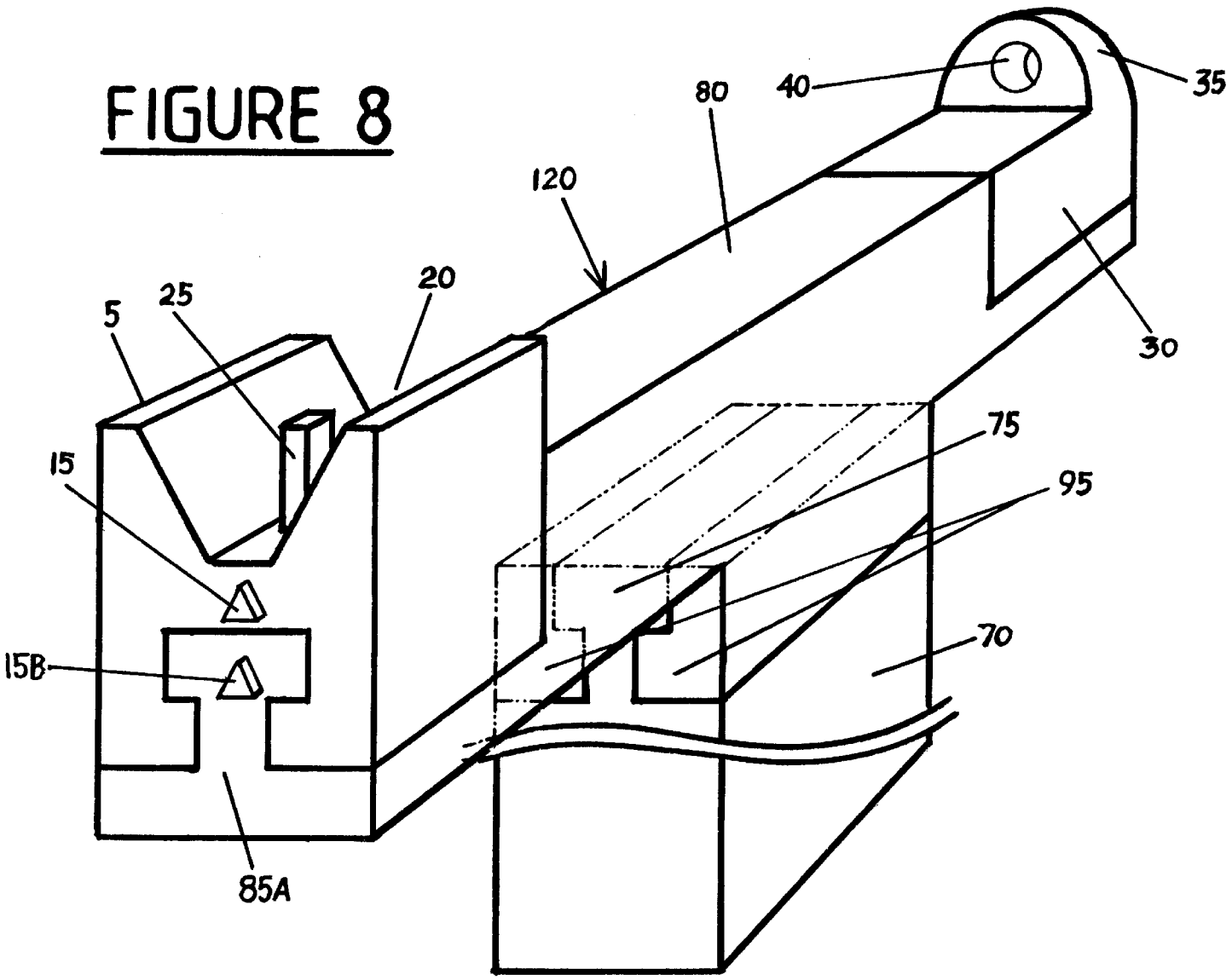
FIG. 8 shows a three quarters view of the simulated firearm sight tool in the peep firearm sight mode.
Figure 9:
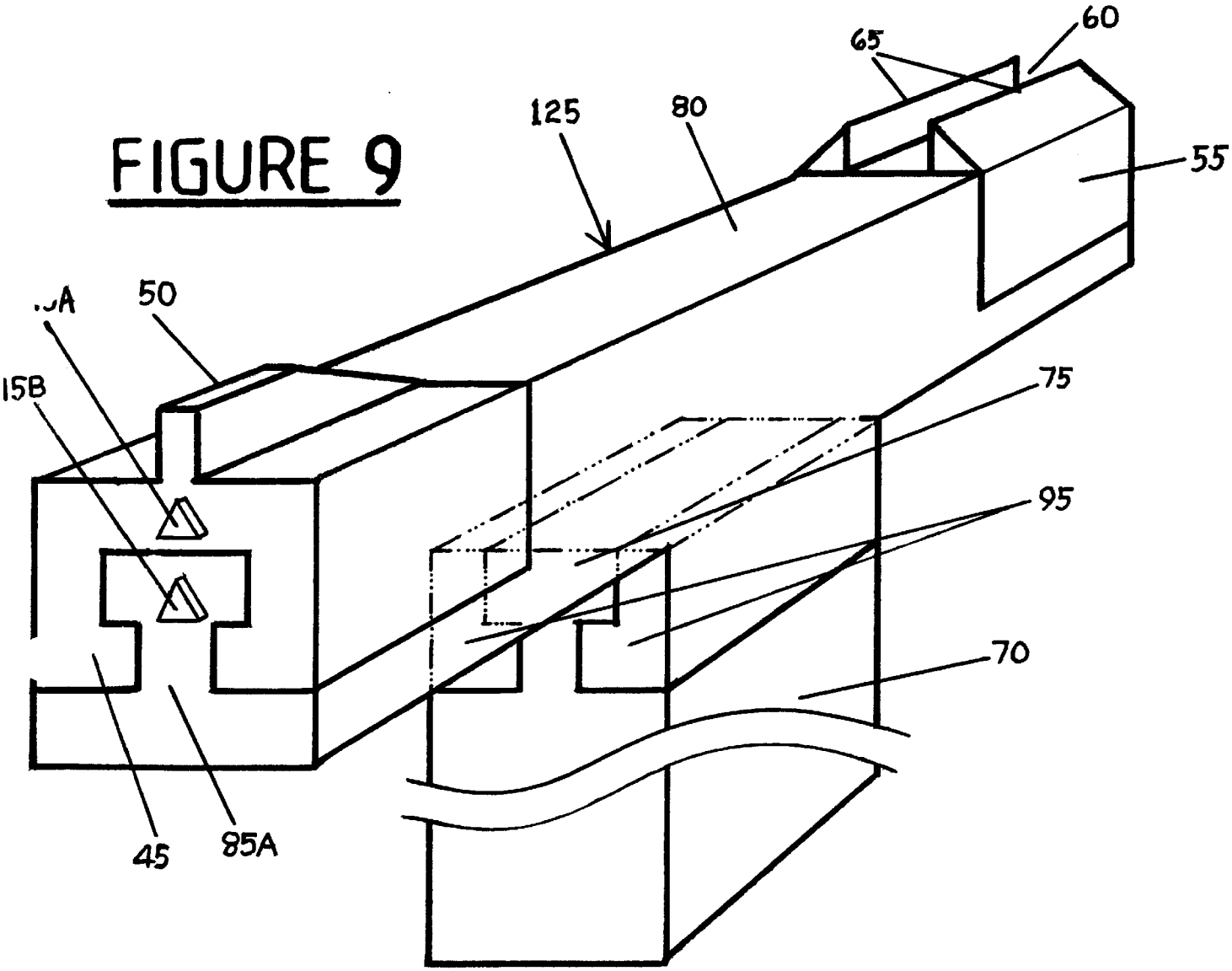
FIG. 9 shows a three quarters view of the simulated firearm sight tool in the open firearm sight mode.
Figure 10:
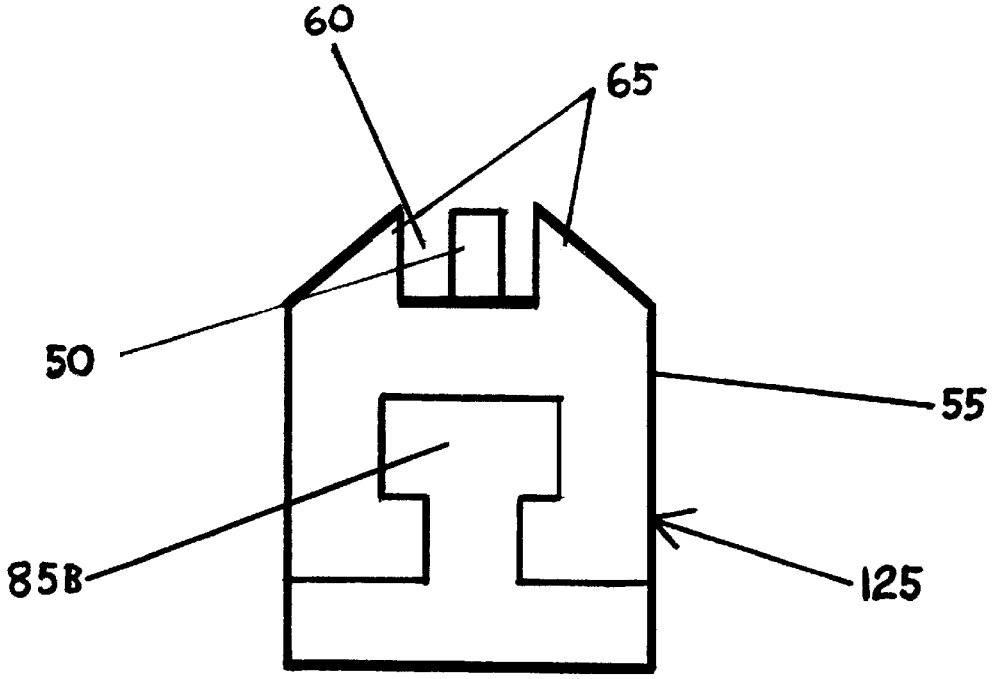
FIG. 10 shows a view of the simulated firearm sight tool in the open firearm sight mode when positioned and viewed to achieve simulated firearm sight alignment.
Figure 11:
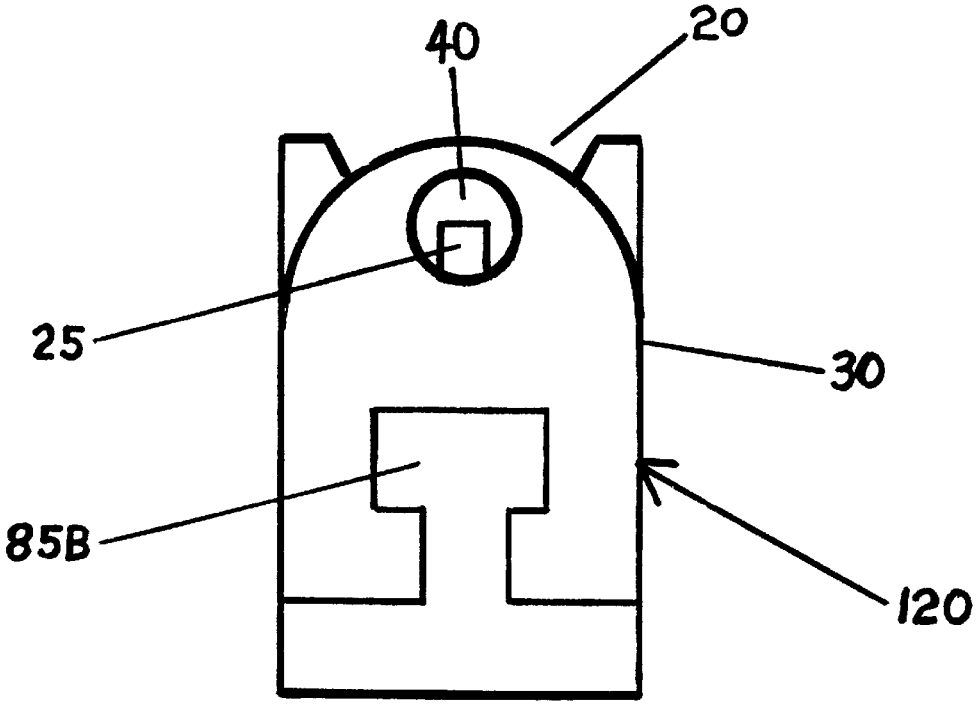
FIG. 11 shows a view of the simulated firearm sight tool in the peep firearm sight mode when positioned and viewed to achieve simulated firearm sight alignment.
Figure 12:
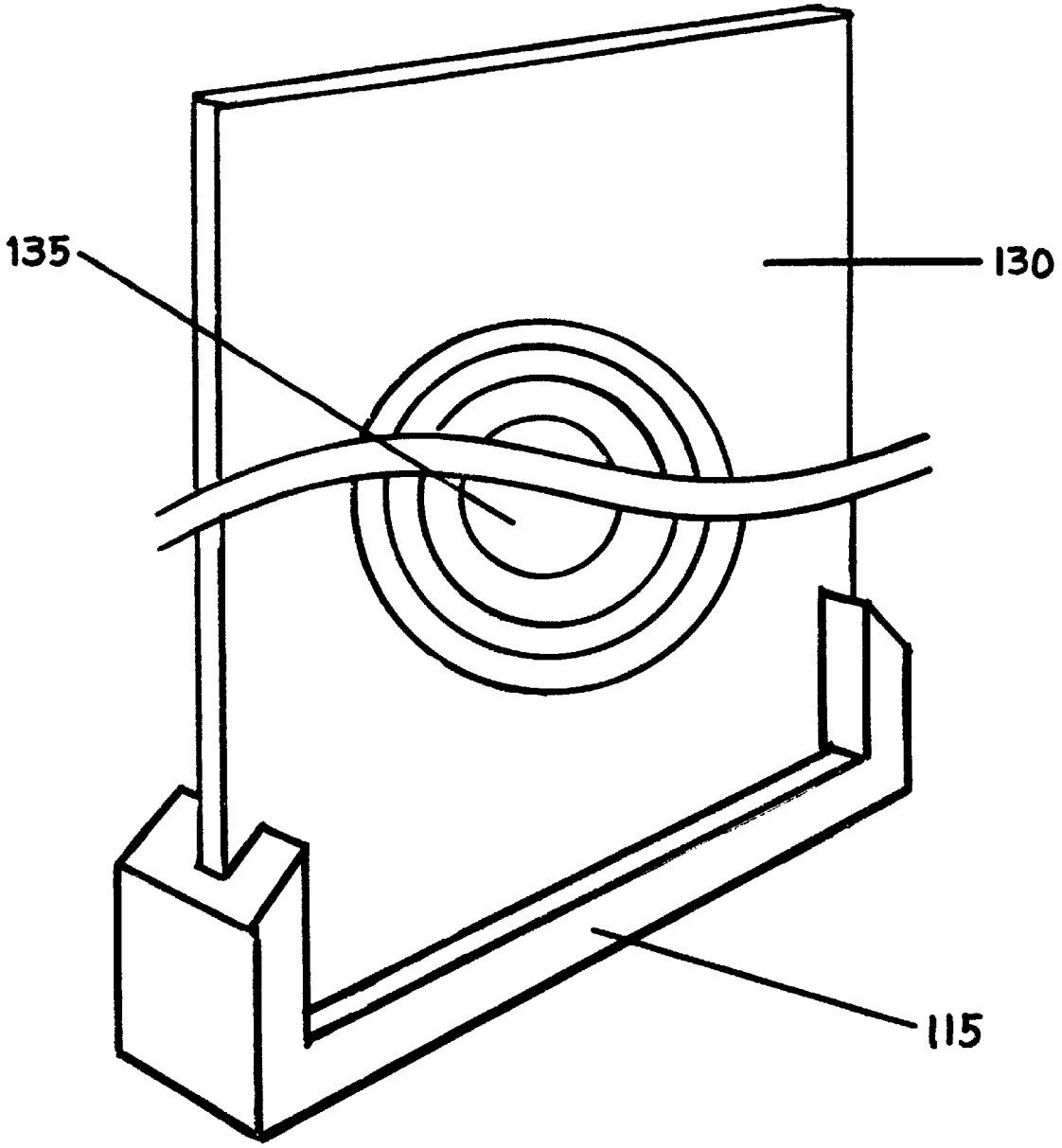
FIG. 12 shows a view of the mini-target holder with a seated mini-target that is holding a target face.

The structure and configuration of the preferred embodiment is now described with reference to FIGS. 1–12. FIG. 9 shows the simulated firearm sight tool in the simulated open firearm sight mode comprising: the simulated front open firearms sight attachment tenon 45, the simulated rear open firearm sight attachment tenon 55, the stock attachment 90 and the barrel 80. The barrel 80 is best seen in FIG. 6. The barrel 80 is a rectangular shaped structure with two "T" shaped mortises 85A, 85B of equal size and shape on both the front top and rear top ends. The front "T" shaped mortise 85A is distinguished by the protruding triangular shaped notch 15B that is centered on the front side of the front "T" shaped mortise 85A. The front "T" shaped mortise 85A is designed to house the simulated front open firearm sight attachment tenon 45. The simulated front open firearm sight attachment tenon 45 is supplied with a centered quadrilateral shaped post alignment indicator 50 with a rectangular cross section on the top side, a longitudinal "T" shamed groove 1013 on the bottom side, and a triangular shaped protruding notch 15A on the front side. The protruding triangular shaped notch 15A is placed onto all parts that attach to the front "T" shaped mortise 85A and is also used as an indicator of the front "T" shaped mortise. The triangular notch is best shown in FIG. 8 and FIG. 9. Also, two "L" shaped semi-longitudinal posts 95 are positioned side by side and centered onto the bottom side of the barrel as shown in FIG. 6A. One of the "L" shaped posts is reversed in its direction so as to create a semi-longitudinal "T" shaped dock 100. This dock 100 is designed to house the longitudinal "T" shaped post 75 of the stock attachment 90. The stock attachment 90 is also supplied with a rectangular base 70. FIG. 9 also shows the simulated rear open firearms sights attachment tenon 55, shown in FIGS. 4 and 4A, that attaches to the rear "T" shaped mortise 85B. The simulated rear open firearm sight attachment tenon 55 is supplied with a centered longitudinal groove 60 that is flanked by two longitudinal triangular shaped cross section posts 65 on the top side, which together serve as an alignment indicator, and a longitudinal "T" shaped groove 10C on the bottom side. FIG. 8 shows the simulated firearm sight tool in the simulated peep firearm sight mode 120. The simulated front open firearm sight attachment tenon 45 and the simulated rear open firearm sight attachment tenons 55 are removed from the barrel's front "T" shaped mortise and rear "T" shaped mortise 85A, 85B and are replaced with the simulated front peep firearm sight attachment tenon 5, shown in FIGS. 1 and 1A, being placed on the front "T" shaped mortise 85A and the simulated rear peep firearm sight attachment tenon 30 being placed on the rear "T" shaped mortise. The simulated front peep firearm sight attachment tenon 5, shown in FIGS. 1, 1A, 2 and 2A, is supplied with a longitudinal syncline shaped groove 20 with a small center mounted rectangular cross section shaped post alignment indicator 25 on the top side, a longitudinal "T" shaped groove 10, shown in FIGS. 1 and 1A, on the bottom side, and a small triangular shaped notch 15 on the front side. The simulated rear peep firearm sight attachment tenon 30 is supplied with a centered aperture alignment indicator 40 that is cut into a semi-longitudinal arch 35 protruding out of the rear top side, and a longitudinal "T" shaped groove 10A , shown in FIGS. 2 and 2A, on the bottom side. The simulated firearm sight tool (FIG. 8 and FIG. 9), when in either mode, is designed for use in conjunction with the mini-target holder (FIG. 7) that is designed as a "U" shaped structure 110. The comers of the "U" are squared with a centered longitudinal groove 60A on the inner side of the "U" shaped structure 110. The mini-target 130, as shown in FIG. 12, is an 8-½"×11" piece of white colored paper that is of the consistency of cardboard, or a thin white colored 8-½"×11" sheet of plastic. This sheet of paper or plastic will hold the print of an originally designed illustration that will represent a target face. The mini-target holder 115, as shown in FIGS. 7 and 12, will hold the mini-target 130 by sliding the mini-target into the centered longitudinal groove 60A on the inner side of the "U" shaped structure.

The operation of the preferred embodiment is now described with reference to FIGS. 1–12. This invention, the simulated firearm sight alignment training system, operates in two modes: simulated peep firearm sight mode 120 and simulated open firearm sight mode 125. When in the simulated open firearm sight mode, as shown in FIG. 9, the simulated front open firearm sight attachment tenon 45, as shown in FIGS. 3, 3A and 3B, is placed onto the front side of the barrel 85A by sliding the longitudinal "T" shaped groove 10B onto the front "T" shaped mortise 85A. The front "T" shaped mortise 85A is identified by a triangular shaped notch 15B that is centered and protrudes from the front side of the front "T" shaped mortise 85A. Then the simulated rear open firearm sight attachment tenon 55 is attached to the barrel, as shown in FIGS. 6 and 6A, by sliding the longitudinal "T" shaped groove 10C onto the rear "T" shaped mortise 85B. Then the stock attachment, as shown in FIG. 5, is placed onto the barrel, as shown in FIG. 6, by sliding the longitudinal "T" shaped post 75 into the "T" shaped dock 100 located on the bottom side of the barrel. The combination of the simulated front open firearm sight attachment tenon, as shown in FIG. 3, the simulated rear open firearm sight attachment tenon, as shown in FIG. 4, and the stock attachment, as shown in FIG. 5, being simultaneously attached to the barrel, as shown in FIG. 6, creates a completely assembled simulated firearm sight tool in the open firearm sight mode, as shown in FIG. 9. Also, a mini-target is placed into the longitudinal groove 60A, as shown in FIGS. 7 and 12, located on the inner side of the "U" shaped mini-target holder body 110. The mini-target holder, as shown in FIG. 7, with seated target, as shown in FIG. 12, is then placed at an approximate distance of five to ten feet and at eye level directly in front of the simulated firearm sight tool user. The user then places the tool into his or her left or right hand by grasping the stock attachment 70, as shown in FIGS. 5 and 9, with the entire hand wrapped like a fist around the stock attachment. The simulated firearm sight tool (FIG. 9) is then to be lifted to approximately two inches in front of the user's open eye and positioned so that that simulated rear open firearm sight attachment tenon 55 is closer to the eye than the simulated front open firearm sight attachment tenon 45. The user then focuses on the quadrilateral shaped post alignment indicator 50 while simultaneously positioning the simulated rear open firearm sight attachment tenon 55 so that the clearly focused quadrilateral shaped post alignment indicator 50 is centered between and of equal height to the two triangular cross section shaped longitudinal posts 65, which together serve as an alignment indicator, as shown in FIGS. 4, 4A, 9 and 10, on the simulated rear open firearm sight attachment tenon 55, as shown in FIGS. 9 and 10. This is simulated firearm sight alignment in the simulated open firearms sights mode. (See FIG. 10.) While maintaining simulated firearm sight alignment in the simulated open firearm sight mode, the clearly focused quadrilateral shaped post alignment indicator 50 is to be placed on the proper or desired aiming point on the mini-target, as shown in FIG. 12. This is simulated firearm sight picture in the open firearm sight mode. To acquire simulated firearm sight alignment in the simulated peep firearm sight mode, as shown in FIG. 1, remove the simulated front open firearm sight attachment tenon, as shown in FIG. 3, from the front "T" shaped mortise 85A, as shown in FIGS. 6 and 9, by sliding the "T" shaped longitudinal grove 10B off the front "T" shaped mortise 85A, as shown in FIGS. 6 and 9. Then attach the simulated front peep firearm sight attachment tenon, as shown in FIG. 1, onto the front "T" shaped mortise 85A, as shown in FIGS. 6 and 8, by sliding the "T" shaped longitudinal groove 10 onto the front "T" shaped mortise 85A. Then, remove the simulated rear open firearm sight attachment tenon, as shown in FIG. 4, by sliding the "T" shaped longitudinal groove 10C off of the rear "IT" shaped mortise 85B. Then attach the simulated rear peep firearm sight attachment tenon, as shown in FIG. 2, onto the rear "T" shaped mortise 85B by sliding the "T" shaped longitudinal groove 10A onto the rear "T" shaped mortise 85B. The combination of the simulated front peep firearm sight attachment tenon, as shown in FIG. 1, the simulated rear peep firearm sight attachment tenon, as shown in FIG. 2, and the stock attachment, as shown in FIG. 5, being simultaneously attached to the barrel, as shown in FIG. 6, creates a completely assembled simulated firearm sight tool in the simulated peep firearm sight mode, as shown in FIG. 8. Then, the mini-target holder, as shown in FIG. 7, with seated mini-target, as shown in FIG. 12, is placed at an approximate distance of five to ten feet and at eye Level directly in front of the simulated firearm sight tool user. The user then places the tool into his or her left or right hand by grasping the stock attachment, as shown in FIG. 5, with the entire hand wrapped like a fist around the stock attachment. Then the simulated firearm sight tool, as shown in FIG. 8, is lifted to approximately two inches in front of the user's open eye and positioned so that the simulated rear peep firearm sight attachment tenon 30 is closer to the eye than is the simulated front peep firearm sight attachment tenon 5. While looking through the centered aperture alignment indicator 40 the user then focuses on the simulated front sight post alignment indicator 25 while simultaneously positioning the centered aperture alignment indicator 40 so that the clearly focused front sight post alignment indicator 25 is centered and at half of the height of the centered aperture alignment indicator 40, as shown in FIG. 11. This is simulated firearm sight alignment in the peep firearms sights mode. While maintaining simulated firearm sight alignment in the peep firearm sight mode, the clearly focused front sight post alignment indicator 25 is aimed at and placed onto the proper or desired aiming point on the mini-target. This is a simulated firearm sight picture in the peep firearm sight mode.

Accordingly, the reader will see that this invention, the simulated firearm sight alignment training system, will, with complete and proper use, teach a person to accurately align the sights of any firearm having peep firearm sights and/or open firearm sights, to correspond to the point of impact of projectiles expelled from said firearm. This system operates in two modes: simulated peep firearm sight mode, and simulated open firearm sight mode. This system is designed for safe, private use at home, in a barracks or squad bay type setting, or in a classroom and does not require the use of a firearm. This system is easy to understand and may be used by all age groups. Furthermore, the simulated firearm sight alignment training system has the additional advantages in that it gives requalifying shooters a useful tool in refamiliarizing themselves with the technique of achieving accurate firearm sight alignment, it is easy to assembly and disassemble, and it is enjoyable to use.

Although the description above contains many specificities, these should not be construed as limiting the scope of the invention but as merely providing illustrations of some of the presently preferred embodiments of this invention. For example, the barrel's front mortise and rear mortise can have other shapes, such as circular, oval, etc.; the triangular shaped notch can have other shapes; the mini-target holder can be designed to have two or more base legs instead of none and may hold the mini-target or any 8-½"×11" paper or plastic for any reason; the rectangular base of the stock attachment can have other shapes, etc. Thus, the scope of the invention should be determined by the appended claims and their legal equivalents, rather than by the examples given.

I claim:

1. A method of using a simulated firearm sight alignment training device by which a person can learn to align the sights of a firearm without using a real firearm comprising the steps of:

a) providing a simulated firearm sight alignment training device having simulated front and rear firearm sights including front and rear firearm sight attachment pieces having front and rear alignment indicators, respectively, said front and rear sight attachment pieces removably attached to front and rear end portions, respectively, of a simulated elongated barrel member, the barrel member being removably attached to a stock member, b) providing a mini-target holder, c) providing a mini-target including a target face, d) lifting said device having simulated front and rear firearm sights to approximately two inches in front of the open eye of a human user, e) positioning the front and rear alignment indicators of said simulated front and rear firearm sights to achieve simulated firearm sight alignment, and f) positioning said device, while maintaining simulated firearm sight alignment, onto said mini-target face to achieve a simulated firearm sight picture.

2. The simulated firearm method of claim 1, wherein said mini-target holder is a "U" shaped structure wherein the corners of said "U" shaped structure are squared and wherein the inner side of said "U" shaped structure has a longitudinal groove.

3. The method of claim 1 wherein said mini target is a 8-½"×11" piece of white colored paper having the consistency of card board or a white colored 8-½"×11 piece of plastic.

4. The method of claim 3 wherein said 8-½"×11" piece of white colored paper or plastic holds a print including a target face.

5. A simulated firearm sight alignment training device for enabling a user to practice firearm sight alignment without the use of a real firearm comprising:

a stock member for grasping in a user's hand, the stock member having a top end and being configured for removable attachment to a simulated elongated barrel member at the top end;

the simulated elongated barrel member being configured to receive the stock member and having a front end portion and a rear end portion, said elongated barrel member being configured for removable, angular attachment at a location along its length to the top end of the stock member, the front end portion of the barrel member being configured for removable attachment to a simulated front firearm sight attachment piece and the rear end portion of the barrel member being configured for removable attachment to a simulated rear firearm sight attachment piece;

the simulated front firearm sight attachment piece being configured for removable attachment to the front end portion of the elongated barrel member, the front attachment piece having a front alignment indicator for sight alignment; and the simulated rear firearm sight attachment piece being configured for removable attachment to the rear end portion of the elongated barrel member the rear attachment piece having a rear alignment indicator for sight alignment;

wherein the front and rear attachment pieces are axially aligned so that a user can practice sight alignment by sighting through the front and rear attachment pieces and aligning the front and rear alignment indicators in said pieces.

6. The simulated firearm sight alignment training device of claim 5 wherein said elongated barrel member is a rectangular shaped structure with a front "T" shaped mortise located on the front end portion of said rectangular shaped structure and a rear "T" shaped mortise located on the rear end portion of said rectangular shaped structure wherein said mortises are of equal shape and size and wherein said front "T" shaped mortise is distinguished by indicia on a front of said front "T" shaped mortise, said barrel member also having two semi-longitudinal "L" shaped posts that are positioned side by side and centered onto a bottom side of said rectangular shaped structure, one of said "L" shaped posts being reversed in direction with respect to the other.

7. The simulated firearm sight alignment training device of claim 5 wherein said stock member is a rectangular shaped structure having a top side with a longitudinal "T" shaped post on the top side.

8. The simulated firearm sight alignment training device of claim 5 wherein the simulated front firearm sight attachment piece and the simulated rear firearm sight attachment piece are simulated open sights.

9. The simulated firearm sight alignment training device of claim 8, wherein said simulated front open firearm sight attachment piece has a top side, a bottom side and a front side, a centered triangular shaped post on the top side, a longitudinal "T" shaped groove on the bottom side and indicia on the front side for identifying the front attachment piece.

10. The simulated firearm sight alignment training device of claim 8, wherein said simulated rear open firearm sight attachment piece has a top side and a bottom side, a longitudinal groove flanked by two longitudinal triangular shaped posts on the top side and a longitudinal "T" shaped groove on the bottom side.

11. The simulated firearm sight alignment training device of claim 5 wherein the simulated front firearm sight attachment piece and the simulated rear firearm sight attachment piece are simulated peep sights.

12. The simulated firearm sight alignment training device of claim 11, wherein said simulated front peep firearm sight attachment piece has a top side, a bottom side and a front side, a longitudinal syncline groove and a small center mounted square shaped post on the top side, a longitudinal "T" shape groove on the bottom side and indicia on the front side for identifying the front attachment piece.

13. The simulated firearm sight alignment training device of claim 11, wherein said simulated rear peep firearm sight attachment piece has a top side and a bottom side, a semi-longitudinal arch that has a centered aperture, said arch protruding from the top side of said piece and said piece having a longitudinal "T" shaped groove on the bottom side.

14. The simulated firearm sight alignment training device of claim 5 wherein the front and rear firearm sight attachment pieces are configured for interlocking connection to the elongated barrel member at the front and rear end portions of the barrel, respectively, and wherein the front and rear end portions of the barrel are configured for interlocking connection to the front and rear firearm sight attachment pieces, respectively.

15. The simulated firearm sight alignment training device of claim 14 wherein the interlocking connections are formed by mortise and tenon joints.

16. A kit of parts for assembly of a simulated firearm sight alignment training device for enabling a user to practice firearm sight alignment without the use of a real firearm comprising:

a stock member for grasping in a user's hand, the stock member having a top end and being configured for removable attachment to a simulated elongated barrel member at the top end of the stock member;

the simulated elongated barrel member being configured to receive the stock member and having a front end portion and a rear end portion, said elongated barrel member being configured for removable, angular attachment at a location along its length to the top end of the stock member, the front end portion of the barrel member being configured for removable attachment to a simulated front firearm sight attachment piece and the rear end portion of the barrel member being configured for removable attachment to a simulated rear firearm sight attachment piece;

said front firearm sight attachment piece being configured for removable attachment to the front end portion of the elongated barrel member and having a front alignment indicator for sight alignment;

said rear firearm sight attachment piece being configured for removable attachment to the rear end portion of the elongated barrel member and having a rear alignment indicator for sight alignment.

17. The kit of parts of claim 16 wherein the simulated front firearm sight attachment piece and the simulated rear firearm sight attachment piece are simulated open sights.

18. The kit of parts of claim 16 wherein the simulated front firearm sight attachment piece and the simulated rear firearm sight attachment piece are simulated peep sights.

* * * * *